United States Patent [19]

Lautenschlaeger

[11] 3,940,828

[45] Mar. 2, 1976

[54] SNAP HINGE

[75] Inventor: Karl Lautenschlaeger, Reinheim, Odw., Germany

[73] Assignee: Karl Lautenschlaeger KG Mobelbeschlagfabrik, Germany

[22] Filed: Jan. 6, 1975

[21] Appl. No.: 538,879

[30] Foreign Application Priority Data

Jan. 11, 1974 Germany ..... 2401178

[52] U.S. Cl. ..... 16/163

[51] Int. Cl.[2] ..... E05D 3/06

[58] Field of Search ..... 16/164, 163, 173, 145, 16/146, 183, 128 R, DIG. 10, 147, 139, 142, 153, 49, 53, 54, 71, 72

[56] References Cited

UNITED STATES PATENTS

| | | | |
|---|---|---|---|
| 3,605,173 | 9/1971 | Lautenschlaeger | 16/163 |
| 3,724,021 | 4/1973 | Lautenschlaeger | 16/164 X |
| 3,772,736 | 11/1973 | Hettich et al. | 16/183 X |
| 3,864,786 | 2/1975 | Salice | 16/163 |

*Primary Examiner*—G. V. Larkin

*Attorney, Agent, or Firm*—Hill, Gross, Simpson, Van Santen, Steadman, Chiara & Simpson

[57] ABSTRACT

A snap hinge for use in connecting furniture doors, for example, to a furniture wall utilizing a pair of pivotally mounted link members and including a spring biased mechanism and a cam control unit associated with said link members for assuring positive closing of a door with which the snap hinge is associated.

12 Claims, 5 Drawing Figures

SNAP HINGE

This invention relates to a snap hinge of the type which may be used for attaching a furniture door to the carrier wall of a piece of furniture and particularly to a hinge of the type formed by two pivoting link members comprising what might be called a quadrilateral link mechanism.

Hinges of this general type are known and these snap hinges have the characteristic that the opening or closing force, respectively, is only exerted within a selected range.

A most desirable characteristic in such a hinge would be that the hinge does not exert a force on the door throughout substantially the entire range of its pivotal movement, thus exerting neither an opening or a closing force in that range of movement. This range should extend between the open position of the door and a position shortly before the door is in a closed position. Only when this position is reached, i.e. shortly before the closed position, should the spring exert a closing force. Such a characteristic enables the door to remain stationary in all positions within the opening range which extends from the complete open position up to shortly before the closed position, and the door thus neither opens or closes by itself. Only when the door has been pivoted from the open position in a direction towards the closed position to such an extent that it is at a position shortly before the closed position, should the closing force which is to maintain the door positively closed after the closing process commence.

Prior art constructions have not provided a satisfactory hinge possessing these desirable characteristics. Thus, the invention has evolved from the problem of trying to make a hinge which is more stable and to allow a more precise functioning of the hinge.

SUMMARY OF THE INVENTION

Accordingly, an object of this invention is to provide a hinge unit having a pair of pivotally mounted link members including cam means for permitting a door with which the hinge unit is associated to move through substantially its full range of movement without any opening or closing force on the door and then to have a positive closing force exerted thereon when the door is close to a closed position.

Another object of this invention is to provide a hinge unit having a pair of pivotally mounted link members and a spring actuated mechanism associated with one of said link members for urging a door with which the hinge unit is associated to a closing position.

Another object is to provide a hinge unit having a pair of pivotally mounted link members and a spring biased mechanism associated with a cam mechanism on one of said link members for assuring positive closing of a door unit with which said hinge unit is associated.

Other objects and advantages of the invention will become more apparent when considering the following description and accompanying drawings.

DESCRIPTION OF PREFERRED EMBODIMENT

Figure 1:
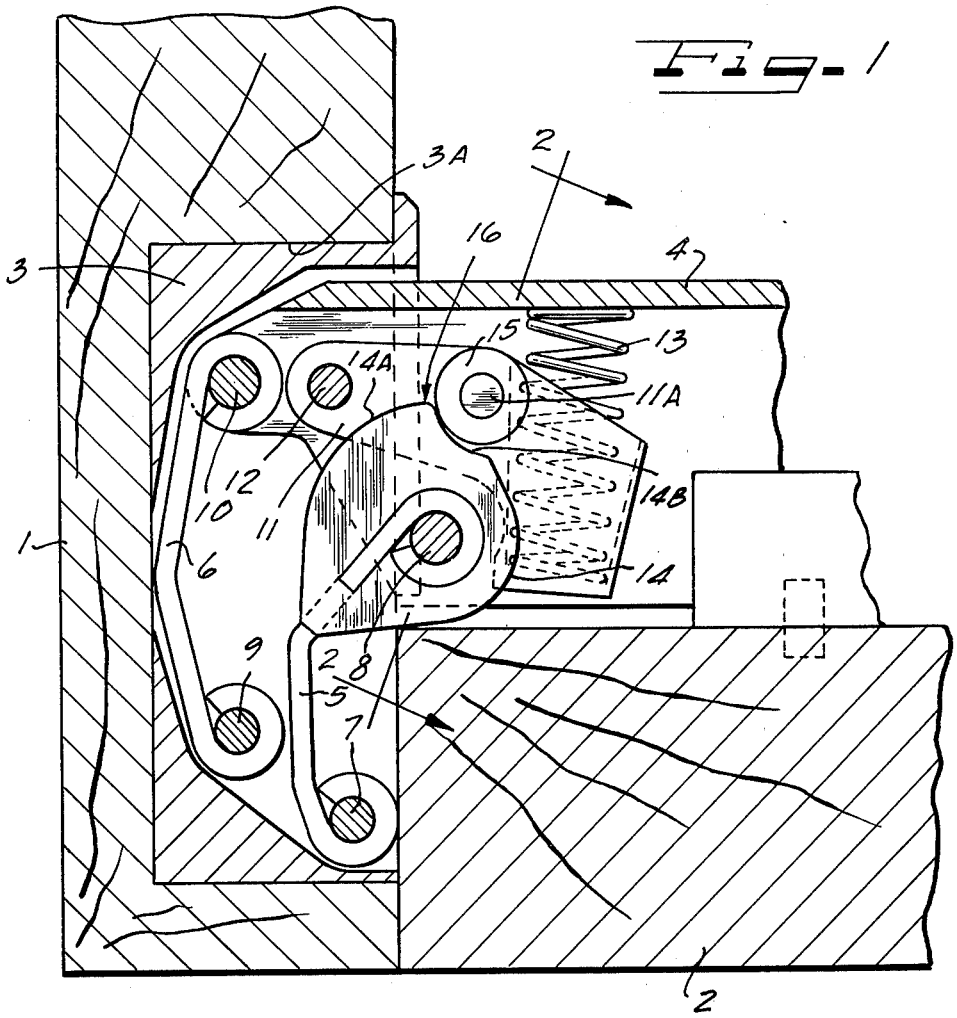
FIG. 1 is a horizontal section of a snap hinge embodying the invention herein showing the hinge mounted on a furniture wall and a door with the door in a closed position.
Figure 3:
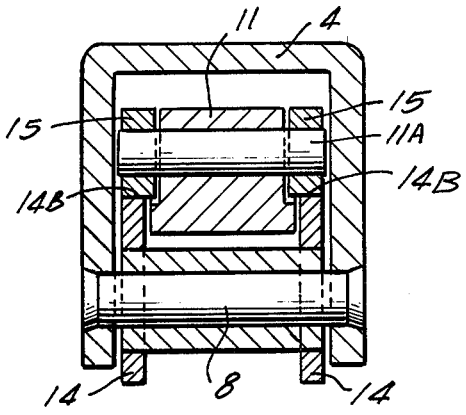
FIG. 3 is a vertical section of the hinge member embodying the invention herein and taken through line 2—2 of FIG. 1.

As can be seen from the drawing, the snap hinge serves for attaching a door 1 to a carrier wall 2 of a piece of furniture. The hinge comprises a dish-shaped housing 3 which is inserted into a corresponding recess 3A of the door, and a carrier arm portion 4 which is constructed as a longitudinally extending inverted U-shaped carrier arm. In FIG. 1 the drawing shows only that end of the carrier arm 4 which is disposed adjacent the snap joint of the hinge.

The two portions, the dish-shaped housing portion 3 and carrier arm 4, are interconnected by a quadrilateral link mechanism comprising an inner link member 5 and an outer link member 6. The inner link 5 is pivotally mounted in the dish-shaped housing 3 by means of a pivot pin 7, and within the carrier arm 4 by means of a pivot pin 8. In the same manner, the outer link 6 is pivotally mounted within the housing 3 by means of a pivot pin 9 and within the carrier arm 4 by means of a pivot pin 10.

An essential element of this snap hinge is the spring biased lever arm 11 which is pivotally mounted at one of its ends by means of the pivot pin 12 attached within the carrier arm 4. The pivoting end of the lever arm 11 is under the effect of a compression spring 13 which urges this pivoting end against a cam means. The cam means is attached to the inner link 5 and comprises two identical laterally spaced cam control discs 14 disposed parallel to each other and which are attached to the end of the pivotal mounting portion of the link 5 which fits around the pivot pin 8. The outer periphery of these control discs 14 define cam surfaces whose path or shape determines the operational characteristics of the hinge. The control discs 14 may be formed integrally with the link 5. They may also, however, be independent elements which may be attached to the link 5, for instance by way of riveting, welding or other suitable means. For illustrative purposes one of the two control discs 14 is shown detached from the link 5 in FIG. 4, while the other control disc is shown connected to the inner link 5.

Cam surfaces 14A and 14B are formed on the edges of the control discs 14. These cam surfaces 14A of the two control discs 14 extend coaxially to the pivot pin 8 throughout the greater part of the periphery thereof as substantially circular arcs. The lever arm 11 of the described embodiment is provided with a pair of rollers 15 mounted at the ends of pin 11A extending transversely through lever are 11 in order to reduce friction.

Figure 2:
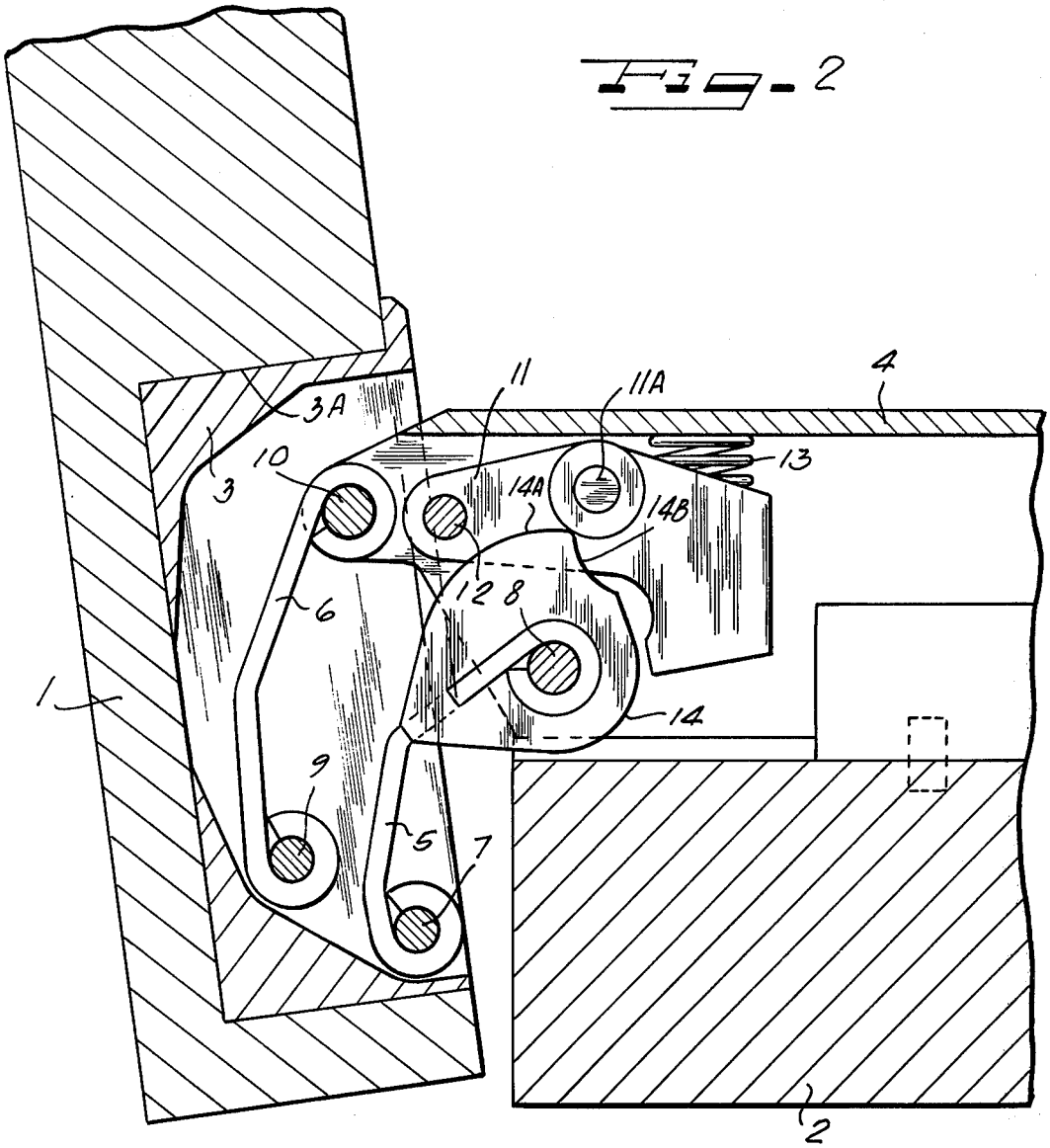
FIG. 2 is a vertical section showing the hinge of FIG. 1 mounted on a furniture wall and a door with the door in a partially open position.
Figure 5:
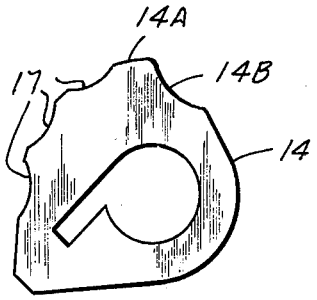
FIG. 5 shows a cam disc having detents formed in the surface thereof.

It can be seen from the FIGS. 1 and 2 that the rollers 15 travel along the substantially circular arc cam surfaces 14A during the greater part of the travel of the door during its swinging movement. When the door is about to close, however, the roller 15 travels on cam surface 14B, i.e. on that part of the two control surfaces within which the distance of the cam surface from the axis of the pivot pin is shorter. It is apparent from viewing FIGS. 1 and 2 that a closing force starts at the instant in which the roller 15 moves past the turning point 16 of the control curve which lies between the cam surfaces 14A and 14B. When the rollers 15 are in contact with the cam surfaces 14B a closing force starts, so that the hinge is firmly urged into a position in which the door is in a closed position as shown in FIG. 1. The total control curve comprising cam surfaces 14A and 14B and intermediate point 16 is the most important feature of the hinge in accordance with this invention.

It should be mentioned that surfaces 14A of the cam control discs 14 may also be provided with one or more small recesses or detents 17 in the center range and/or in the range of the open position for selectively holding the door in selected open positions as the rollers 15 are received in those recesses 17.

In the hinge shown here as a preferred embodiment the door remains open in almost its entire open range, and does not strike open entirely or close with an impact. The force closing the door has an effect only shortly before the closed position and will then cause the door to be closed entirely automatically and then remain positively closed.

The present invention embodies a particularly reliable construction for hinges with quadrilateral link mechanism due to the application of two control discs 14 which are arranged at as large a distance from one another as possible at the edges of the link 5. This provides a stable guidance for the two pressure rollers 15. It is possible in this manner to utilize the entire width of the pivotal mounting portion of the link 5 as a bearing surrounding the pivot pin 8.

Figure 4:
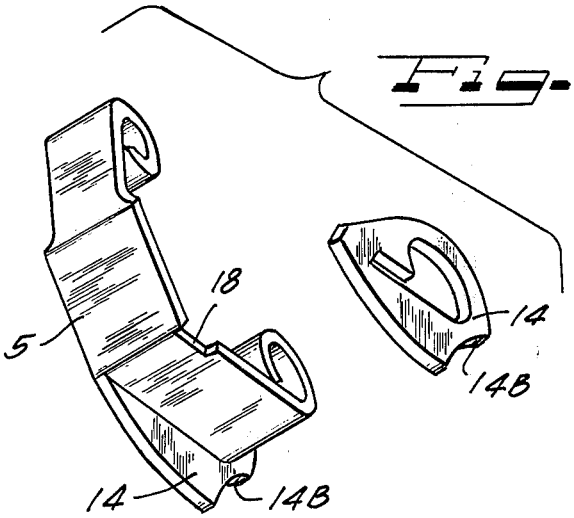
FIG. 4 is an exploded view in perspective of the inner link of the hinge of FIG. 1 showing one of the cam control discs detached from the link member.

In the case where the control discs 14 are first produced as separate parts, FIG. 4 shows a perspective view of the inner link 5 with one of the two control discs 14 formed integrally with the link while the other disc has been shown separately. It can be seen that these control discs can be attached to the edges of the link since the edges have been provided with recesses 18 for this reason. The fixed connection of the attached control discs 14 with the link 5 can be effected by way of peening the margins.

Although the operation of the hinge embodying the invention should be clear from the above description the operation will be briefly summarized. Starting with the door 1 in a closed position as shown in FIG. 1, the compression spring 13 urges the lever 11 downwardly pressing the rollers 15 against cam surfaces 14B thereby urging the control discs 14 and the link 5 counterclockwise about pivot pin 8 to a positive closing position. When the door is slightly opened as shown in FIG. 2 the lever 11 is urged upwardly as the clockwise rotation of control discs 14 and link 5 causes the rollers 15 to ride upwardly on the cam surfaces 14B until they hit intermediate point 16. Further opening movement of the door 1 allows the rollers 15 to ride on the cam surfaces 14A with an equal pressure on the spring 13 because all points on the cam surfaces 14A are equidistant from the axis of the pivot pin 8, at least until the door 1 has reached a full open position. This allows the door to be placed at any of a number of selected open positions and remain at that particular open position without any force tending to further open or close the door.

When the door is to be closed the opposite takes place. When the control disc has rotated far enough counterclockwise to reach point 16 and an almost closed position compression spring 13 takes over and automatically makes rollers 15 ride down cam surfaces 14B to urge control discs 14 and link 5 further counterclockwise bringing the door 1 positively to a closed position.

While a preferred embodiment of the invention has been disclosed it will be appreciated that this has been shown by way of example only, and the invention is not to be limited thereto as other variations will be apparent to those skilled in the art and the invention is to be given its fullest possible interpretation within the terms of the following claims.

What is claimed is:

1. A snap hinge for furniture doors having a carrier arm adapted to be mounted on the carrier wall of a piece of furniture and a housing adapted to be mounted in a door portion comprising:

a quadrilateral link mechanism including outer and inner longitudinally extending link members each having ends pivotally supported in the carrier arm and the housing thereby pivotally interconnecting the carrier arm and housing;

a lever arm having one end pivotally mounted on said carrier arm and the free end thereof being oscillatable in a plane perpendicular to the pivotal axis of said link members;

cam control means fixed on the end of said inner link member which is pivotally mounted in the carrier arm;

cam engaging means on said lever arm engaging said cam control means; and biasing means urging said cam engaging means into engagement with said cam control means.

2. The snap hinge of claim 1 wherein said biasing means is a spring means operatively associated with said lever arm.

3. The snap hinge of claim 1 wherein said biasing means comprises a compression spring means disposed between the free end of said lever arm and the carrier arm.

4. The snap hinge of claim 1 wherein said cam control means comprises cam control disc means connected to said inner link member and pivotable therewith, said cam control disc means lying in a plane perpendicular to the pivotal connections of said link members.

5. The snap hinge of claim 4 wherein said cam control disc means is formed integrally with said inner link member.

6. The snap hinge of claim 4 wherein said cam control disc means comprises a pair of cam control discs formed separately from said link member and includes cooperating means on said link member and said control discs for securing the latter to said link member.

7. The snap hinge of claim 1 wherein said cam control means comprises a pair of cam control discs connected to said inner link member and pivotable therewith, said cam control disc means lying in a plane perpendicular to the pivotal connections of said link members.

8. The snap hinge of claim 1 wherein said cam control means comprises a pair of laterally spaced cam control discs connected to said inner link member; and said cam engaging means on said lever arm includes transversely extending members connected to said lever arm which engage said cam control discs.

9. The snap hinge of claim 8 wherein said lever arm swings between said cam control discs.

10. The snap hinge of claim 1 wherein said cam control means comprises a pair of laterally spaced cam control discs connected to said inner link member each of said discs being formed with a first cam surface lying at a relatively greater distance from the inner link pivotal connection with the carrier arm and a second cam surface connected with said first cam surface and lying at a relatively lesser distance from the inner link pivotal connection whereby when said cam engaging means contacts said second cam surface the door is biased toward a closed position.

11. The snap hinge of claim 1 wherein said biasing means comprises spring means effective to urge said cam engaging means on lever arm into engagement with said cam control means; and said cam control means comprises cam control disc means connected to said inner link member and pivotable therewith, said cam control disc means lying in a plane perpendicular to the pivotal connections of said link members.

12. The snap hinge of claim 1 wherein said cam engaging means on said lever arm includes transversely extending portions connected to said lever arm and roller elements mounted on said portions.

* * * * *